US009297142B2

(12) United States Patent
Winkelman et al.

(10) Patent No.: US 9,297,142 B2
(45) Date of Patent: Mar. 29, 2016

(54) DREDGE VESSEL SYSTEM

(75) Inventors: Marius Otto Winkelman, Nijkerk (NL); Hendrik Ratering, Nijkerk (NL)

(73) Assignee: DAMEN DREDGING EQUIPMENT B.V., Nijkerk (NL)

( * ) Notice: Subject to any disclaimer, the term of this patent is extended or adjusted under 35 U.S.C. 154(b) by 514 days.

(21) Appl. No.: 13/254,814

(22) PCT Filed: Jul. 2, 2010

(86) PCT No.: PCT/EP2010/059500

§ 371 (c)(1),
(2), (4) Date: Apr. 19, 2012

(87) PCT Pub. No.: WO2011/003838

PCT Pub. Date: Jan. 13, 2011

(65) Prior Publication Data

US 2012/0198733 A1 Aug. 9, 2012

(30) Foreign Application Priority Data

Jul. 6, 2009 (WO) ..... PCT/EP2009/058526

(51) Int. Cl.

| | |
|---|---|
| ***E02F 3/88*** | (2006.01) |
| ***B63B 35/30*** | (2006.01) |
| ***E02F 3/90*** | (2006.01) |
| ***E02F 3/92*** | (2006.01) |
| ***E02F 7/02*** | (2006.01) |
| ***E02F 9/06*** | (2006.01) |

(52) U.S. Cl.

CPC ..... *E02F 3/885* (2013.01); *B63B 35/303* (2013.01); *E02F 3/905* (2013.01); *E02F 3/9243* (2013.01); *E02F 7/023* (2013.01); *E02F 9/067* (2013.01)

(58) Field of Classification Search

CPC ..... E02F 3/88; E02F 3/905; E02F 3/907; E02F 3/885; E02F 5/006; E02F 5/28; E02F 3/9243; E02F 7/023; E02F 9/067; B63B 35/303

USPC ..... 37/307, 334, 345, 317

See application file for complete search history.

(56) References Cited

U.S. PATENT DOCUMENTS

| | | | | | |
|---|---|---|---|---|---|
| 2,534,917 | A | * | 12/1950 | King | 37/309 |
| 3,739,503 | A | * | 6/1973 | Barker et al. | 37/308 |
| 3,820,258 | A | * | 6/1974 | Fahrner | 37/317 |

(Continued)

FOREIGN PATENT DOCUMENTS

| | | | |
|---|---|---|---|
| CN | 2509235 | Y | 9/2002 |
| CN | 2591105 | Y | 12/2003 |

(Continued)

*Primary Examiner* — Robert Pezzuto
*Assistant Examiner* — Jessica H Lutz
(74) *Attorney, Agent, or Firm* — Patterson Thuente Pedersen, P.A.

(57) ABSTRACT

A system for recovering immerged sediments from a seabed and discharging them. From a free sailing extraction ship a mixture of water and sediment is suctioned by a submerged pump unit through a flexible hose adapted to be rolled on a rotative reel positioned on the extraction ship, while the ship is sailing over the concession. The suctioned mixture is then immediately delivered to one of a series of free sailing carrier and transport units that sail alongside.

11 Claims, 7 Drawing Sheets

(56) References Cited

U.S. PATENT DOCUMENTS

| | | | | | |
|---|---|---|---|---|---|
| 3,919,790 | A | * | 11/1975 | Sasaki et al. | 37/329 |
| 3,975,842 | A | * | 8/1976 | Andreae | 37/322 |
| 4,242,815 | A | * | 1/1981 | Vermeulen | 37/308 |
| 4,351,122 | A | * | 9/1982 | Cornelis et al. | 37/308 |
| 4,501,446 | A | * | 2/1985 | Glaser et al. | 299/9 |
| 4,680,879 | A | * | 7/1987 | Hill et al. | 37/331 |
| 5,042,178 | A | * | 8/1991 | Dutra | 37/341 |
| 5,129,167 | A | * | 7/1992 | Nakahara | 37/318 |
| 5,300,219 | A | * | 4/1994 | Braid | 210/122 |
| 6,149,811 | A | * | 11/2000 | Hodges et al. | 210/328 |
| 6,343,559 | B1 | * | 2/2002 | Thomas | 114/27 |

FOREIGN PATENT DOCUMENTS

| | | | | | |
|---|---|---|---|---|---|
| CN | 2764713 | Y | | 3/2006 | |
| CN | 2799674 | Y | | 7/2006 | |
| FR | 2 919 015 | | | 1/2009 | |
| JP | 61021238 | A | * | 1/1986 | E02F 3/88 |
| JP | 61117333 | A | * | 6/1986 | E02F 3/90 |
| JP | 2001-348905 | A | | 12/2001 | |
| JP | 2003-268798 | A | | 9/2003 | |
| JP | 2003268798 | A | * | 9/2003 | E02F 3/90 |
| JP | 2001-247077 | A | | 9/2011 | |

* cited by examiner 29
15a
15b
15
27

10
100
11
1
130
110
120
5
9a
9b
300
FW
150

140
7b
10
26b
21
L2
7
26a
L1
7a
13
3
B
A
11
30
11c

DREDGE VESSEL SYSTEM

PRIORITY CLAIM

The present application is a National Phase entry of PCT Application No. PCT/EP2010/059500, filed Jul. 2, 2010, which claims priority from PCT Application No. PCT/EP2009/058526, filed Jul. 6, 2009, the disclosures of which are hereby incorporated by reference herein in their entirety.

TECHNICAL FIELD

The invention refers to a floating dredge vessel dedicated to recovering materials from the seabed and discharging the recovered materials into a barge.

BACKGROUND OF THE INVENTION

As shown in FIGS. 1-4 of either Japanese Patent Publications No. JP2001247077 or JP2001348905, a dredge vessel having:

- a structure comprising a hull and a deck,
- a steering means and a motor for steering and moving the dredge vessel forward,
- a reel positioned on the deck,
- an elongated flexible suction hose adapted to be rolled onto the reel and unrolled from the reel and lowered down into the water,
- an rigid dredging head connected to a first end of the flexible suction hose and having a first free end having a downward oriented opening for drawing a downwardly oriented suction, when rested on the seabed,
- a pump connected to the flexible suction hose for suctioning a mixture of materials and water there through,
- hoisting means positioned on the deck and having hanging ropes adapted to be wound and unwound and connected to both the rigid dredging head and a hanging rope length controller, for:
  - moving the flexible suction hose and rigid dredging head between an inactive position located onboard and an active position located overboard,
  - immersing and elevating the flexible suction hose and rigid dredging head,
- at least one delivery tube which is:
  - connected at a first end to the flexible suction hose, and
  - extended at a second end by a delivery head for discharging the recovered materials therethrough off the dredge vessel and into a barge,
- the delivery tube and delivery head being adapted to move relative to the deck, for being:
  - stored above the deck in a stored zone,
  - and deployed outside the dredge vessel, in a deployed zone, when the recovered materials have to be discharged off the dredge vessel.

SUMMARY OF THE INVENTION

Embodiments of the invention are directed at increasing the rate at which dredged materials are recovered, particularly when the vessel is dredging on the open sea instead of near a harbor where the dredged materials can be readily delivered ashore.

Particularly in view of the disclosure of either JP2001247077, or JP2001348905, the present invention:

- improves the rate at which the seabed is explored,
- together with improving the efficiency and safety of suctioning materials and then the transferring the dredged materials to the barge(s).

As such, the rate at which the materials are suctioned from the seabed must be balanced against the rate at which the dredged materials are delivered to the barge(s).

The present invention, according to an embodiment, can comprise a dredge vessel having:

- a structure comprising a hull and a deck,
- a steering means and a motor for steering and moving the dredge vessel forward,
- a reel positioned on the deck,
- an elongated flexible suction hose adapted to be rolled onto the reel and unrolled from the reel and lowered down into the water,
- a rigid dredging head connected to a first end of the flexible suction hose and having a first free end having a downward oriented opening for drawing a downwardly oriented suction, when rested on the seabed,
- a pump connected to the flexible suction hose for suctioning a mixture of materials and water there through,
- hoisting means positioned on the deck and having hanging ropes adapted to be wound and unwound and connected to both the rigid dredging head and a hanging rope length controller, for:
  - moving the flexible suction hose and rigid dredging head between an inactive position located onboard and an active position located overboard,
  - immersing and elevating the flexible suction hose and rigid dredging head,
- wherein the hoisting means is adapted for:
  - towing an immersed flexible suction hose and rigid dredging head when the dredge vessel is moving forward and materials are being suctioned,
  - while orienting the rigid dredging head, wherein the rigid dredging head having first free end directed backwards and positioned underwater on the seabed,
- a suction hose length controller for controlling the length of the flexible suction hose unrolled from the reel,
- a main length controller connected to both the flexible suction hose length controller and the hanging rope length controller for adjusting the unrolled length of the flexible suction hose according to an unwound length of the hanging ropes, in such a way that the flexible suction hose, which has a determined length between the rigid dredging head and the sea surface, when the dredge vessel is moving forward and said materials are being sucked, is curved along said determined length, whatever the tilt of the rigid dredging head,
- at least one delivery tube which is:
  - connected at a first end to the flexible suction hose, and
  - extended at a second end by a delivery head for discharging the recovered materials therethrough off the dredge vessel and into a barge,
- the delivery tube and delivery head being adapted to move relative to the deck, for being:
  - stored above the deck in a stored zone,
  - and deployed outside the dredge vessel, in a deployed zone, when the recovered materials have to be discharged off the dredge vessel.

According to an embodiment, the present invention can further comprise a connector linking the delivery tube with the flexible suction hose such that the suctioned mixture, including water, is discharged off the dredge vessel into the barge through the delivery head. In this configuration, the dredge vessel has neither a pit nor a hopper for storing recovered materials aboard the dredging vessel.

A dredging method, according to an embodiment of the present invention and directed to the same improvements over the prior art, the method comprising:

providing a dredging head having a first free end and a flexible hose adapted to be rolled and unrolled on a rotative reel positioned on a dredge vessel, wherein the dredging head is connected to the dredge vessel by the flexible hose, towing the dredging head and the flexible suction hose behind the drudge vessel such that the dredging head is submerged, wherein the length of the flexible suction hose submerged is such that the flexible suction hose beneath the water is curved regardless of the tilt of the dredging head, controlling the tilt of the dredging head beneath the water such that the first free end of the dreading head is directed backwards and resting on the seabed, suctioning from the first free end of the dredging head a mixture of water and materials through the flexible hose while the dredge vessel is sailing forward over the sea bed, delivering the materials from the dredge vessel to at least one barge, wherein the materials are immediately delivered from the dredge vessel to the at least one barge while additional material is being suctioned from the sea bed such that no material accumulates on the dredge vessel, According to an embodiment, the curvature of the towed flexible suction hose can be varied according to the unwound length of the hanging ropes.

Similarly, the immersed length of the flexible suction hose can be adjusted such that the flexible suction hose is longitudinally loosened while the rigid dredging head is resting on the seabed suctioning material.

According to an embodiment, the at least one barge floating alongside said dredge vessel can further comprise a loading compartment having a predetermined volume, the loading compartment having an open top and charged with said mixture of materials suctioned from the sea bed and water. The open top permits water to overflow from the loading compartment when said recovered materials charged therein exceeds the predetermined volume.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
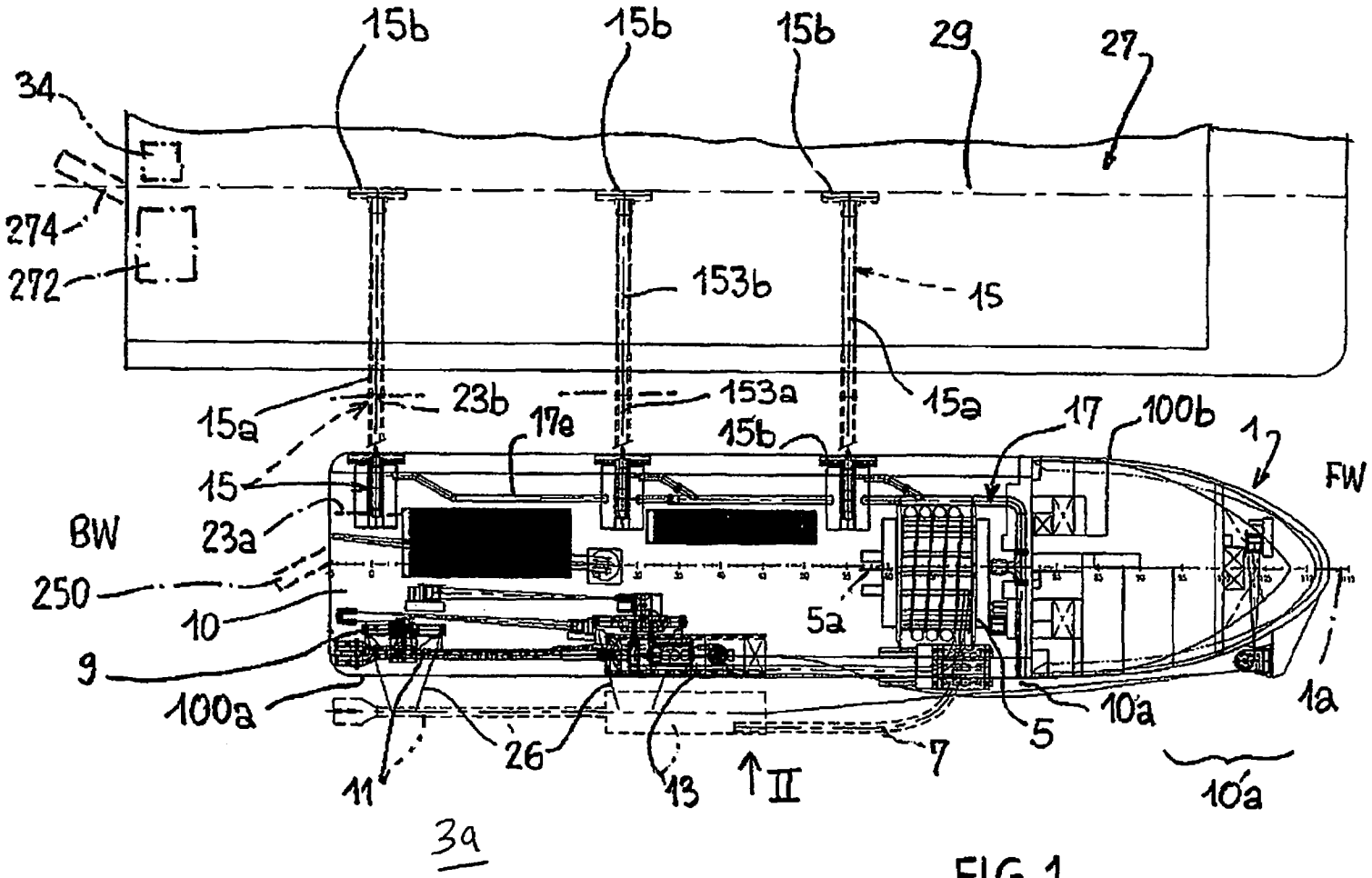
FIG. 1 is a schematic top view of a barge adapted to be loaded with the dredged mixture by a dredging vessel according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Figure 2:
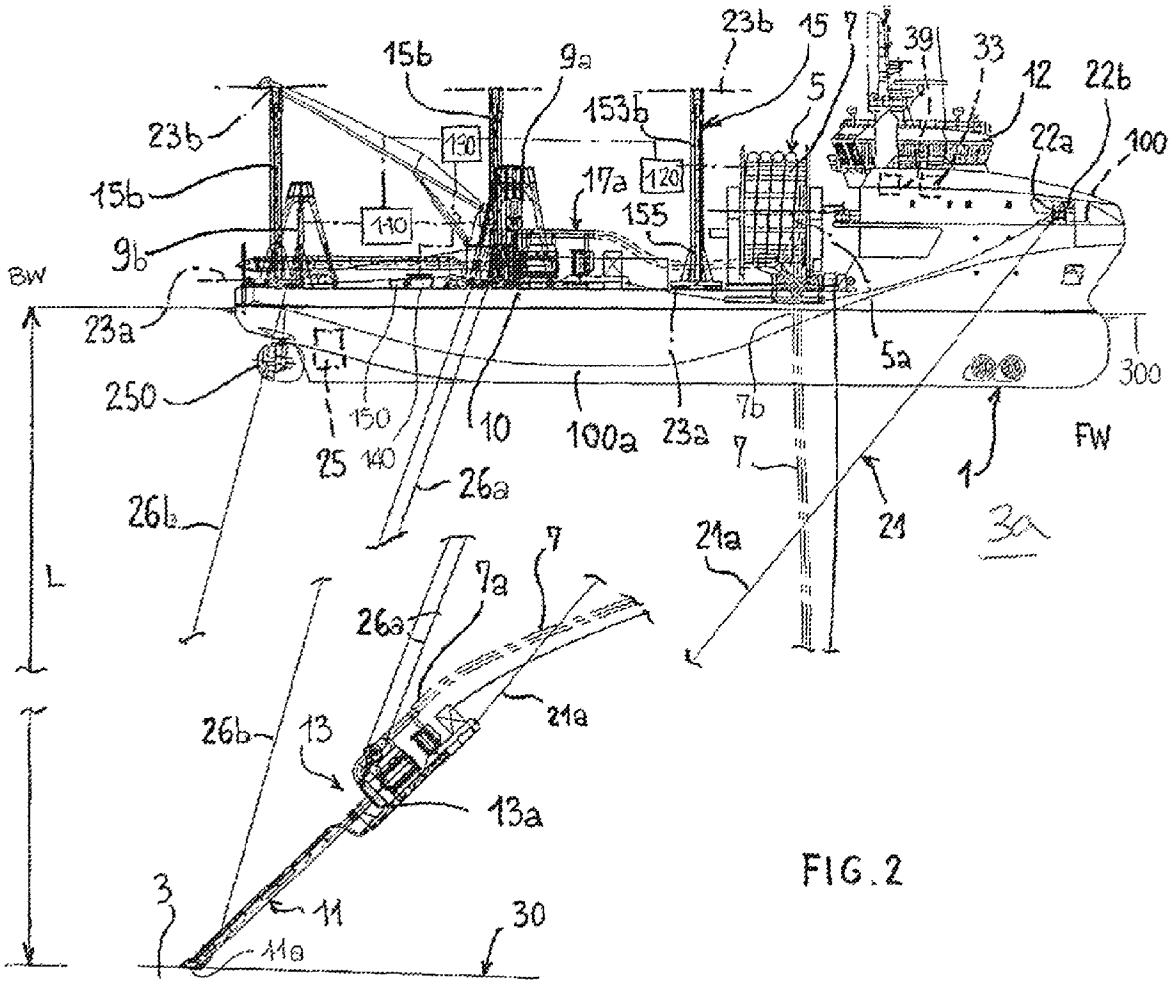
FIG. 2 is a lateral side view of a dredging vessel according to an embodiment of the present invention.

As shown in FIGS. 1, 2, a dredge vessel 1, according to an embodiment of the present invention, dedicated to extract materials 3 from water 3*a* and discharge said materials onto an adjacent barge for transport to a determined destination.

Materials can comprise sand, gravel, sediments and any other substance which can be suctioned from the seabed.

Seabed means the bottom of the ocean (or sea or any large body of water).

The vessel 1 comprises a structure 100 having a hull 1*a* covered by a (rear) deck 10 having an elevated frontward bridge deck 12.

According to an embodiment, on the deck 10 of the dredge vessel 1 are provided the following means: a rotative reel 5 on which a elongated flexible suction hose 7 is adapted to be rolled; hoisting means 9 for immersing, elevating and towing the suction hose 7; a rigid dredging head 11 disposed at a first end 7*a* of the flexible suction hose 7 for dredging the materials 3; pumping means 13 connected to the suction hose 7; for suctioning a mixture of materials and water through the suction hose 7; a discharging unit 15 having a series of delivery heads 15*b* adapted for discharging the suctioned mixture (materials and water) outside the dredge vessel; and a delivery pipe unit 17 disposed on said dredge vessel between the suction hose 7 and the discharging unit 15 for delivering the suctioned mixture from the suction hose 7 to the discharging unit 15.

The rigid dredging head 11 is an elongated structure defining a longitudinal axis. Said structure 11 is not an underwater vehicle, such as vehicle 32 disclosed in FR-A-2919015.

This rigid dredging head 11 has a first free end 11*a* opened downward for downwardly directing a suction force downward when rested on the seabed 30.

The reel 5 is adapted to rotate around a horizontal axis. The suction hose 7 can be unrolled from the reel the suction hose 7 and submerged upwardly convey the materials when the pump 13 is operative. According to an embodiment, the suction hose 7 can be adapted to convey a water-material mixture.

The suction hose 7 can comprise a tube made of flexible elastic material. According to an embodiment, the suction hose 7 can be mechanically reinforced.

Since the dredging can be operated on the open sea and the hose 7 is windable around the reel 5, the length of said hose is longer than the length of the vessel.

For towing the dredging head 11 underwater, from a portion of the vessel is located forward (FW) of the hoisting means 9 positioned toward the rear of the deck 10, the dredge vessel further comprises a towing means 21.

As shown in FIG. 2, the towing means 21/21*a* can extend between a front part 10' *a* of the hull 1*a* and the dredging head 11.

According to an embodiment, the hoisting means 9 and reel 5 will be disposed on said deck such that the flexible suction hose 7, together with the dredging head 11 will be adapted to be moved between:

- a first non operative position in which the flexible suction hose 7 and the dredging head 11 are positioned above the deck, on a lateral side 10*a* thereof proximate to a first lateral side 100*a* of the hull, and,
- a second operative position in which the flexible suction hose 7 and the dredging heat 11 are positioned within the water by being hoisted laterally and downwardly along said first lateral side 100*a* of the hull.

First lateral side 100*a* can be either starboard or portside.

According to an embodiment, the axis 5*a* around which the reel 5 rotates to roll the flexible suction hose 7 onto the reel 5 is parallel to a roll axis Ia of the vessel to make movement of the flexible suction hose/dredging head assembly easier. Aligning the reel 5 such that the axis 5*a* is parallel to the roll axis Ia also improves the overall stability of the vehicle.

As also illustrated in FIG. 2, the towing means can comprise a cable 21*a* having a variable length extending between the vessel(hull 1*a*) and the dredging head 11 for an underwater steering of the dredging head while the vessel is sailing.

A role, or drum, 22*a* is coupled with a motor (winch) means 22*b* such that the length of the towing means can be adjusted according to the water depth, referenced L on FIG. 2.

If the assembly 7/11 is hoistable along the lateral side 100*a* of the hull such that the drum 22*a* is positioned proximate to the forward area of the lateral side 10*a*/100*a*. The motor means 22*b* can be operated from the bridge deck 12 that is located close to the prow.

Positioning the drum 22*a* on a fore-deck 100 at a higher level than the lower rear deck 10 permits adapting the length of the towing means allowing faster and safer intervention should any problem occur.

Fore-deck 100 is located close to the bridge deck 12 and forward therefrom.

As illustrated in FIG. 1, the delivering pipe unit 17 provided on the deck 10 can comprise rigid pipes 17 affixed to and over the dredge vessel deck for transferring the suctioned mixture from the flexible hose 7 to the discharging unit 15.

Figure 3:
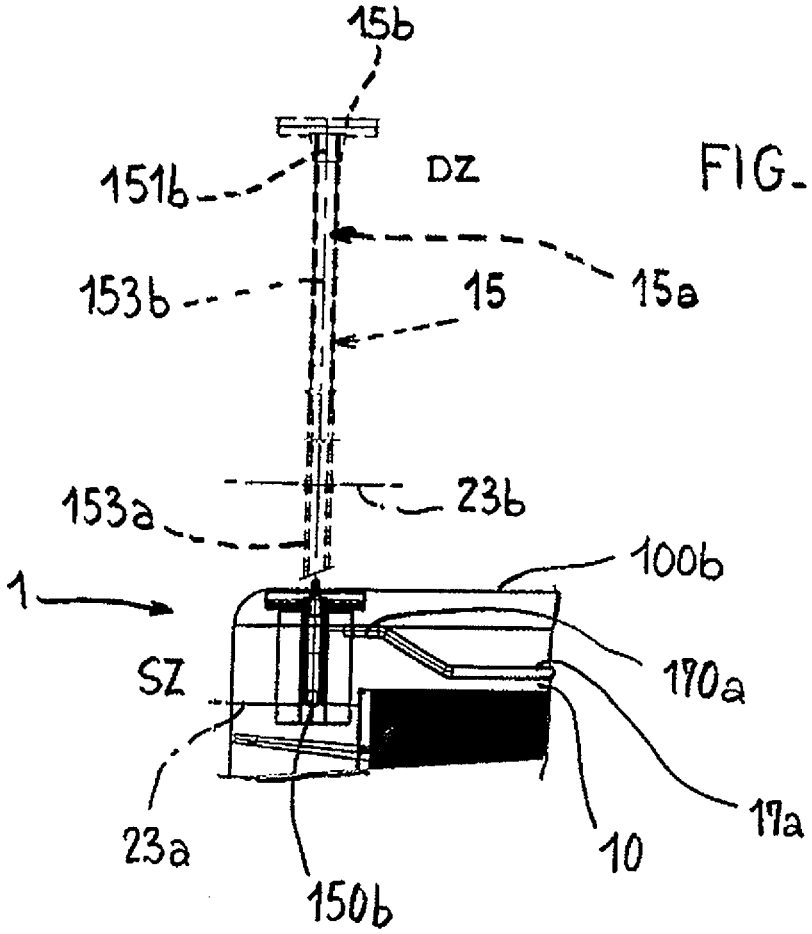
FIG. 3 is a top view of the dredging vessel depicted in FIG. 2.
Figure 4:
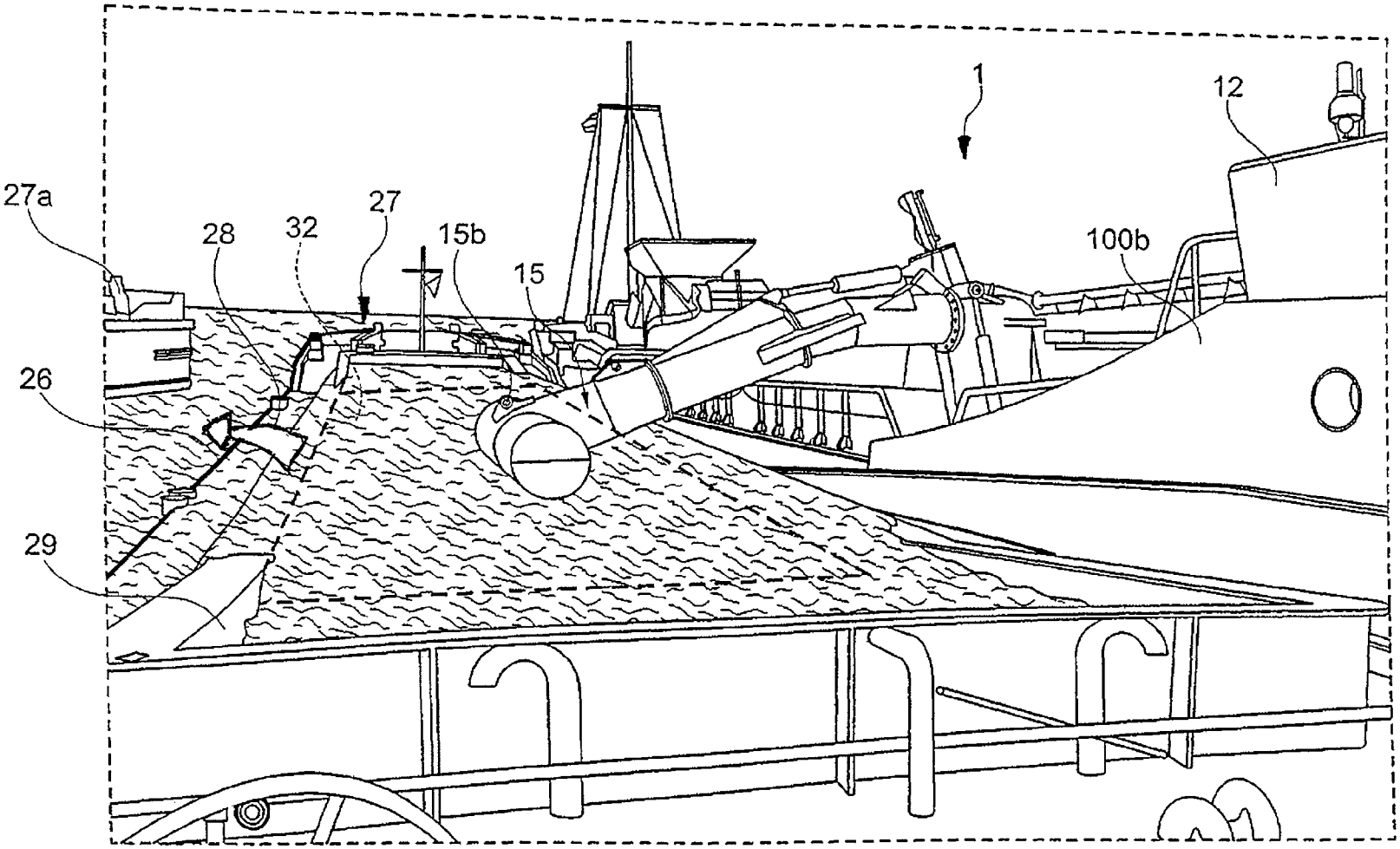
FIG. 4 is an illustrative view of the transport material between the dredging vessel and the barge.

As shown in FIGS. 3 and 4, for improving the speed and efficiency of the dredging operation, the discharging unit 15 can comprise a rigid tube 15*a* connected at a first end 170*a* to the delivering pipe unit 17 and, at a second end 151*b*, to the delivering head 15*b*.

As illustrated, the delivering head 15*b* extends transversally to the tube 15*a* and is adapted to be positioned outside the dredge vessel.

In said illustrations, the discharging tubes 15*a* and delivering heads 15*b* are horizontal such that the heads extend parallel to the longitudinal axis of both the vessel and the adjacent barge (see FIG. 1) to define a corresponding elongated passage for the materials.

As shown FIG. 1, a series of parallel discharging tubes/heads 15*a*/15*b* can be provided along the second lateral side 100*b* of the hull 1*a* (see also FIG. 4).

From the above description and the figures, it can be understood that the flexible hose 7, together with the rigid dredging head 11 and the pump 13 are adapted to be lowered and elevated over one of the sides of the vessel (starboard or portside) 100*a*.

The hoisting means 9 comprises cables 26 connected to the dredging head 11 and are disposed on lateral side 10*a* of the deck 10.

Cables 26 are adapted to be wound and unwound and connected to both the rigid dredging head 11 and a hanging rope length controller 110.

The hanging rope length controller 110 comprises winches connected to the hanging ropes 26. The hanging rope length controlled 110 can further comprises sensors and/or other length measurement devices connected to a computer unit.

The hoisting means 9 with the hanging rope length controlled 110 are adapted for:

- towing the immersed flexible suction hose 7 and rigid dredging head 11 when the dredge vessel 1 is moving forward and materials are being suctioned,
- controlling a tilt A of the rigid dredging head such that the first free end 11*a* is directed backward (BW) and resting on the seabed 30, under water.

According to an embodiment, the vessel can further comprise a suction hose length controller 120, for controlling the length of the flexible suction hose unrolled from reel 5.

The suction hose length controller 120 is similar to the hanging rope length controller 110 as both are adapted to control, and if necessary adjust, the length of a structure which can be rolled/unrolled or wound/unwound. As a consequence, means used for the hanging rope length controller 110 can be used for the suction hose length controller 120.

Similarly, the vessel can also comprise a main length controller 130 connected to both the flexible suction hose length controller 120 and the hanging rope length controller 110.

The main length controller 130 is a supervisor controller provided for adjusting, the unrolled length of the flexible suction hose 7 with the unwound length of (at least one of) the hanging ropes 26, such that the flexible suction hose is curved along length L1, regardless of the tilt A of the rigid dredging head (see FIGS. 1, 6, 8), when the dredge vessel is moving forward (FW) and said materials are being suctioned through hose 7.

Figure 5:
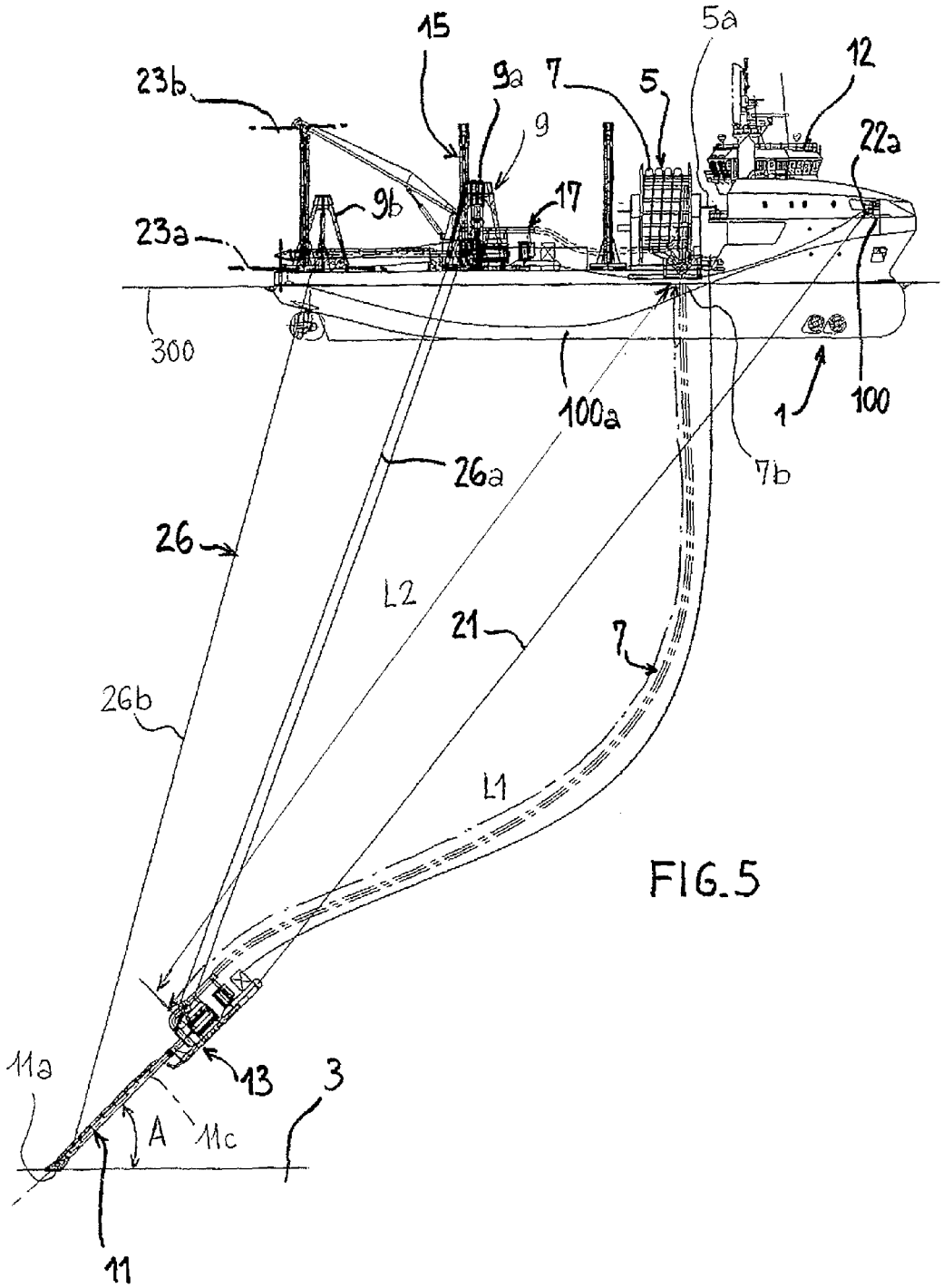
FIG. 5 is an enlarged view of the dredging vessel depicted in FIG. 2.
Figures 6, 7:
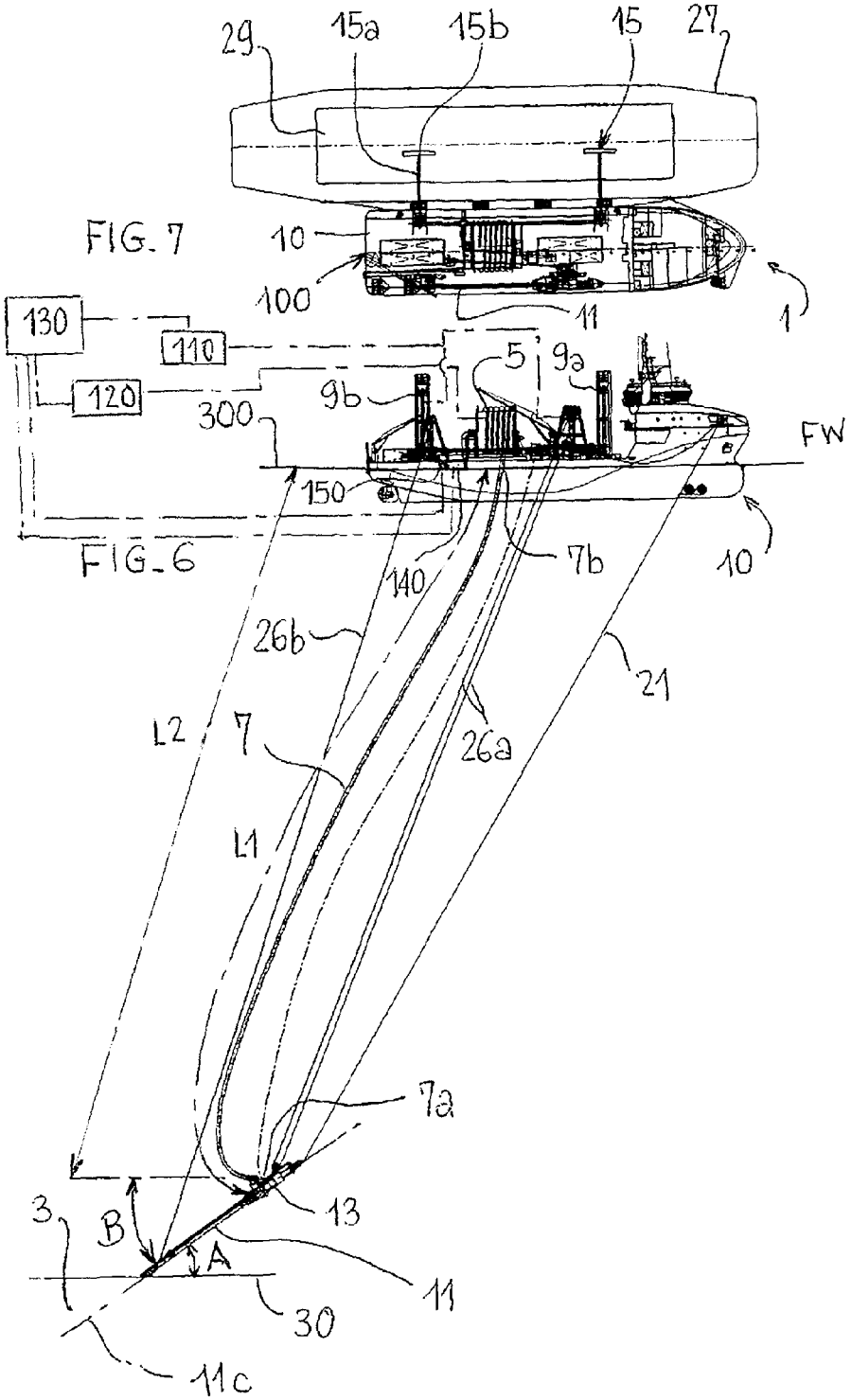
FIG. 6 is a lateral side view of a dredging vessel according to an embodiment of the present invention.
FIG. 7 is a top view of the dredging vessel depicted in FIG. 6 with the barge.
Figure 8:
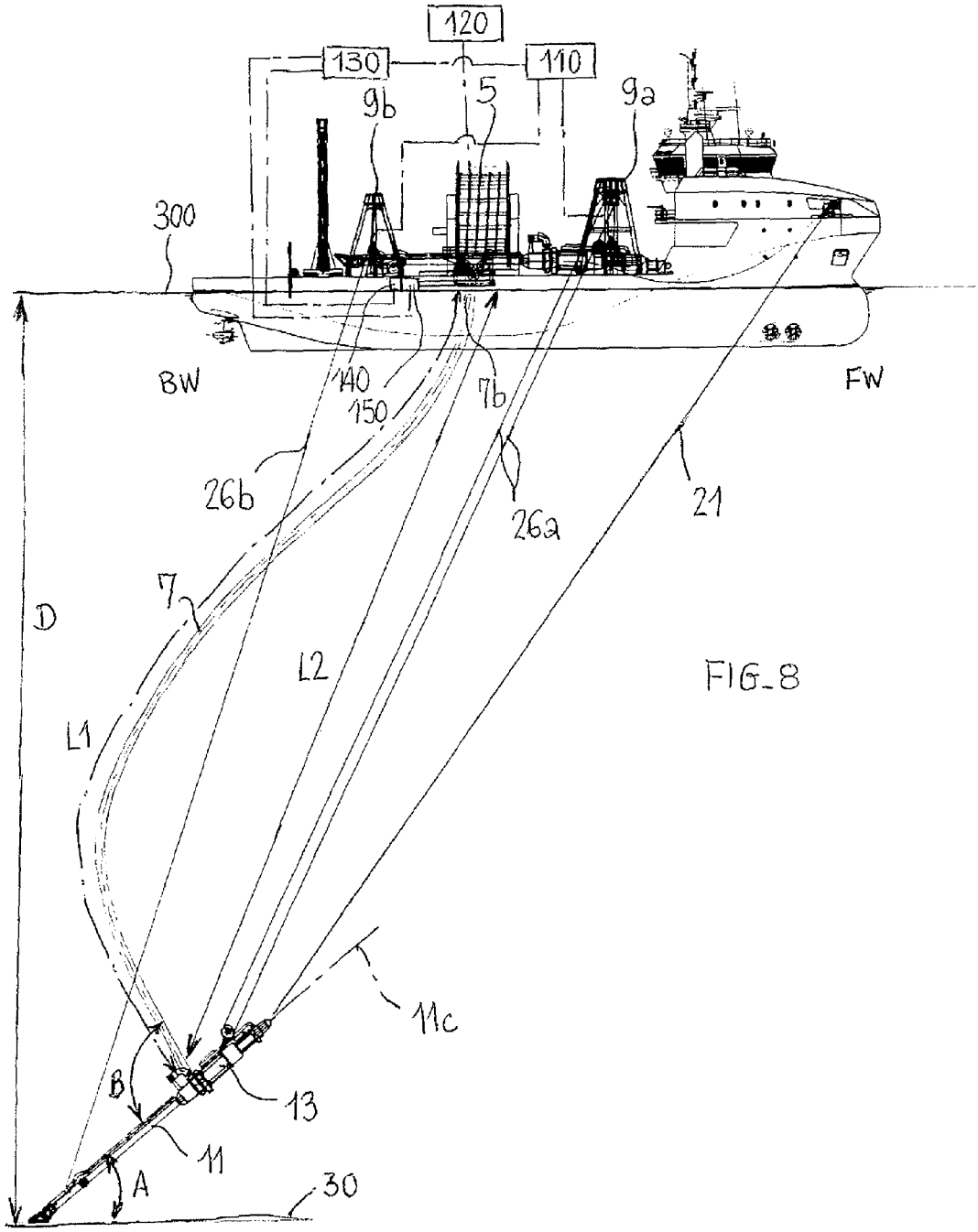
FIG. 8 is a lateral side view of a dredging vessel according to an embodiment of the present invention.

As illustrated, L1 is the hose length along its axis 11*a* between the rigid dredging head (connection 7*a*) and the sea surface 300 at the location 7*b*, which is where the hose 7 enters the water (see FIGS. 5, 6, 8).

As such, L2, the rectilinear length between the rigid dredging head and the sea surface 300, is then less than L1. Similarly, the unwound lengths of cables 26*a*, 26*b* are less than L1 when a suction is being drawn.

The curvature can change based on the forward speed of the vessel and the resistance of water.

Further, the remaining length rolled around the reel 5 and/or the remaining length wound around at least one of said hanging ropes 26 could be used instead of the respective unrolled and unwound lengths.

This main length controller 130, or supervisor controller, comprises a computer connected to both the above-cited computers of the flexible suction hose length controller 120 and the hanging rope length controller 110.

The reference number (zero) can be the respective length of the hose 7 unwound when the dredging head 11 is on the deck 10 (see FIG. 1).

A measurement device 140 disposed on board is adapted to measure or calculate the vertical distance D (FIG. 8) between the seabed (in front of the dredging head, forward) and the vessel to determine the water depth between the sea surface 300 and the seabed 30.

A sensor 150, such as a "sonar" can be used to determine the vertical distance D.

The measurement device 140 can be integrated with sensor 150 and connected to respective length controllers 110, 120, 130. According to an embodiment, the measurement device 140 is at least connected to supervisor length controller 130.

According to the data registered by the measurement device 140, the respective controllers 110, 120, 130 can each be operated individually or in unison to adjust the corresponding length of the component under its control.

This prevents the flexible solution hose 7 and the suction operation to be affected if the seabed level changes and/or the waves become too high.

The discussed unrolled/rolled and unwound/wound lengths of each component are each measured or calculated with reference to a predetermined reference length.

As shown in FIGS. 1 and 3, the discharging unit 15 is adapted to move, specifically rotate, relative to the dredge vessel to minimize the effect of swells and waves on the delivering head, wherein the discharging head is:

stored above the deck 10, in zone SZ; FIG. 3, deployed outside the dredge vessel in a deployed zone (DZ FIG. 3), when the suctioned mixture is to be discharged outboard.

Specifically the discharging unit can be adapted to rotate relative to the dredge vessel deck about a first and a second horizontal axis, respectively 23*a*, 23*b*, for rotating between said stored and deployed positions and for an up and down movement of delivering head 15*b*, respectively. As shown in FIG. 3, the axis of rotation 23*a*, 23*b* of the discharging unit 15 in this configuration are each parallel to axis Ia.

In this configuration, the discharging unit can move up an down around horizontal axis.

This arrangement limits the space that must be reserved for said discharging unit, on the deck. The arrangement allows the discharging unit to be stored in an upright position when not in use. (see FIGS. 1, 3).

According to an embodiment, each tube 15*a* can further comprise at least a first and a second elongated (tube) portions, respectively 153*a*, 153*b*, having a point of articulating at the middle of the tube proximate to the horizontal axis 23*b*. The first elongated portion 153*a* can be further articulated at a lower end 155 where it is connected to the deck 10 (horizontal axis 23*a*, FIG. 1).

As shown in FIGS. 1-3, when in the non-operative state, the first and second elongated portions 153*a*, 153*b* are folded in a substantially vertical orientation, with axis 23*b* upward and backward and discharging head 15*b* down and backward, whereas, in the operative state (dotted lines FIGS. 1, 3) the first and second elongated portions are deployed backward into an axis parallel with horizontal axis discharging head 15*b* is positioned forward above the barge 27. According to an embodiment, the barge can comprise a motorized barge such as a tug boat or a self propelled.

In order to improve the suction, the pumping means 13 comprises a dredge pump 13*a* disposed near the dredging head 11 so that the dredge pump is also immersed when the dredging head is dredging the materials (see FIG. 2).

For precise positioning of the vessel on the dredging zone, the dredge vessel 1 can further comprise one or more inboard propulsion motor means 25 controlled from the bridge deck 12.

Specifically, the inboard propulsion motor means can be adapted for positioning the dredge vessel while the materials 3 are being dredged from the dredging zone 30 (such as the sea bottom) and the mixture suctioned.

Consequently, the dredge vessel will not require any riverbed attaching means, seabed attaching means, riverbed anchoring means and seabed anchoring means (such as traditional anchors) which are adapted for temporary maintaining a dredge vessel when materials are dredged and mixture suctioned.

As a consequence, the vessel will then be a "free sailing" ship.

As shown in FIG. 4, a floating barge 27 is adapted to be disposed alongside the dredge vessel 1 (see also FIG. 1).

As shown in FIGS. 1, 4, such a barge 27 will be situated along said second lateral side 100*b* of the hull, in front of (below) the discharging unit 15 extended to its deployed operative position.

Said floating barge 27 is a floating unit which is adapted to both transport and carry the materials. It has a hull 26, a deck level 28 and a loading compartment 29 above which the discharging unit head 15*b* can be dispose for discharging the suctioned mixture into said loading compartment.

The loading compartment 29 can comprise an open top.

Further, the following system(s) improve(s) the adaptability of the invention to deliver the mixture outside the dredge vessel 1 above said sediment loading compartment 29. Specifically, a follow-me positioning system could control the respective positions of the dredge vessel and the floating barge.

The follow-me position system allows for the vessel and unit to sail substantially side by side (side 100*a* of vessel 1) for safe transfer of suctioned mixture from the vessel 1 to the unit 27 when swells and/or waves are high. This is particularly advantageous as it is possible to removably attach together the dredge vessel and the floating barge when said mixture is to be discharged from the dredge vessel to unit 27 without mooring lines.

The speed and course controls of both the extraction ship and the barge can be synchronised through the respective motor means 25, 272 and the rudders 250, 274 of vessel 1 and unit 27, respectively (see FIG. 1). Under the control of the respective tiller man/men, such means would maintain both vessels 1, 27 within a predetermined distance range (laterally and longitudinally) during the dredging and/or transfer operations.

Said rudders and a tiller located within the gangway globally define steering means adapted to allow the vessel 1 to be steered.

Alternatively, an electronic positioning system 33 could be installed on the vessel 1, for dynamically controlling the respective positions of said vessel and the floating barge 27 when the mixture is to be discharged from the vessel to unit 27. The positioning system 33 and motor means 25 would then be connected together.

Preferably unit 27 will also be provided with an electronic positioning means 34 wirelessly connected to the positioning system 33 and adapted to control motor 272 and rudder 274.

Mooring means and/or fendering means can be used between vessel 1 and barge 27 in conjunction with the positioning system 33.

During transfer, the discharging unit head 15*b* will be located in the deployed zone DZ (FIG. 1) and can have its horizontal and/or vertical position (s) adjusted as a function of the degree of sediment loading of unit 27 and the respective positions of the vessel 1 and the floating barge 27.

For improving the speed and the efficiency of charging the sucked mixture onto the barge 27 the loading compartment 29 opens upwards on the deck level 28 and can be adapted to freely communicate with outside, so that water of the discharged suctioned mixture will progressively overflow off the ship as said mixture is progressively charged in the loading compartment 29.

According to an embodiment, the floating barge 27 does not comprise any cover means for covering loading compartment 29 (see FIG. 4).

Furthermore, for speeding the discharging operation of the suctioned materials when unit 27 is full of materials and water has escaped from the mixture delivered in said compartment 29, the floating barge 27 could be a split-barge adapted to be loaded from an open top and discharged through the bottom of its hull (see zone 32 FIG. 4 where movable flaps can be disposed in the bottom of compartment 29 as a part of the hull).

From the above description, it is clear that using a barge 27 having an open top loading compartment 29, together with the above-cited discharging unit 15, will allow the barge to be charged with the recovered mixture, water included, wherein the open top—allows water to overflow from the loading compartment when the recovered materials 3 charged therein exceeds the predetermined volume of the loading compartment 29.

The connection between the delivering tube 15*a* and the flexible suction hose 7 will preferably be adapted for having all the suctioned mixture, including suctioned water discharged outside the dredge vessel and into the barge 27, through the delivering head(s) 15*b*. In this configuration, the dredge vessel 1 has with neither pit nor hopper nor compartment (such as compartment 29), for storing recovered materials 3 sucked through the hose on the dredging vessel.

From FIGS. 1, 6, 8, it will further noted that, preferentially:

the hoisting means 9 will comprise front and rear hoists 9*a*, 9*b* provided with respective front and rear hanging ropes 26*a*, 26*b*, the reel (5) will be disposed on deck 10:

either between the front and rear hoists, or ahead the front hoist 9*a*, and the flexible suction hose 7 will be connected laterally from above to the rigid dredging head 11, 13 either with an angle B relative to the rigid dredging head axis 11*a*, or, coming from ahead, along a direction parallel to said rigid dredging head axis lie (see FIG. 5).

As shown in FIG. 8, the angle B is substantially a right angle, but can also comprise a slanted angle, as shown on FIG. 6, for allowing hose 7 coming from above and the rear (BW) to connect the rigid dredging head 11.

As shown in FIG. 2, in which reel 5 is disposed in front of the front hoist 9*a*, the flexible suction hose 7, coming from ahead (FW) and above, is connected to said rigid dredging head 11,13 in a direction parallel to the rigid dredging head axis 11*a*.

In the three illustrated embodiments, both the front and rear hanging ropes 26*a*, 26*b* are attached to the rigid dredging head 11, 13, for adjusting said tilt A.

This arrangement improves the efficiency of the tilt control A, since it can operate forward and backward.

A dredging method, which can be operated with all or part of the above described means, is adapted for recovering the immersed materials 3 from the seabed concession 30 and immediately discharging them into a barge.

The method comprises:

from a first free end of the immersed dredging head 11, suctioning a mixture of water and materials 3 through said flexible hose 7, delivering the materials from the dredge vessel to at least one barge 27, the step of suctioning comprising:

suctioning said mixture while:

the dredge vessel is sailing forward over the seabed 30, the immersed dredging head 11 and flexible suction hose are towed by the dredge vessel, the under water tilt A of the immersed dredging head is controlled, such that the dredging head has its first free end 11*a* directed backwards (BW) and resting on the seabed 30, and, the flexible suction hose has its immersed length such that the flexible suction hose 7 is curved therealong, whatever said tilt A, and, the above step of delivering the materials to the barge comprises continuously delivering said materials while the mixture is suctioned through the towed suction hose.

Further, as above indicated:

the curvature of this hose 7 will preferably vary depending on the unwound (or wound) length of the hanging ropes 26, 26*a*, 26*b*, and, the step of delivering comprises immediately delivering the suctioned mixture to said one of the series of barges that is sailing alongside, while the mixture materials+ water is suctioned through the flexible suction hose such that there is accumulation of materials 3 on vessel 1.

In order to prevent the flexible suction hose from being compromised by forces acting on the hose the step of adapting the immersed length of the flexible suction hose further comprises adjusting such the length of the hose such that the flexible suction hose 7 is longitudinally loosened, viz. substantially untensioned, longitudinally, while the rigid dredging head is resting on the seabed 30 and the mixture is being suctioned.

In the same way, it is recommended that:

from the free sailing extraction ship 1, the mixture of water and materials 3/3*a* be suctioned by the pump unit 13—preferably the submerged pump unit 13*a*—through the suction flexible hose 7, while the ship 1 is sailing over the seabed, and the suctioned mixture being immediately delivered from the extraction ship to one of a series of free sailing barges 27 that are sailing alongside.

Preferably:

during the present operations, said plurality of empty barges of the series will sail in the vicinity of the extraction ship 1 (see FIG. 4), and, when said one free sailing barge, such as 27, that sails alongside the extraction ship is full of suctioned materials, one empty barge, such as 27*a*, will be substituted for the full one, as soon as possible.

The step of suctioning the mixture of water and sediment 3/3*a* can be performed together with the step of delivering the suctioned mixture—through the discharging/delivering unit 15/15*b*—be conducted simultaneously.

According to an embodiment, the vessel 1 can be pushed or pulled by a tub boat if the vessel 1 is not a self propelled vehicle.

Similarly, while the dredging vessel is especially adapted to dredge in open sea, it could also be used in any water, including rivers, lakes.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A dredge vessel for recovering materials from a seabed and discharging said recovered materials into a barge, the dredge vessel comprising:

a structure comprising a hull and a deck:

a steering means and a motor for steering and moving the dredge vessel in a forward direction:

a reel positioned on said deck:

an elongated flexible suction hose and adapted to be rolled onto the reel and unrolled down into the water:

a rigid dredging head connected to a first end of the flexible suction hose and having a first free end opened downward for downwardly directing a suction when resting on the seabed:

a pump operably carried by the dredge vessel and operably coupled to the flexible suction hose for suctioning therethrough a mixture of said materials and water:

a towing means comprising a towing cable extending downwardly and rearwardly from said dredge vessel structure to said rigid dredging head for transmitting towing forces to said dredging head and thereby isolating the flexible suction hose from towing forces;

a hoisting means disposed on said deck and having at least two hanging ropes having hanging rope lengths extending from the ship to the dredging head, the hanging ropes each adapted to be wound and unwound and connected to both the rigid dredging head and a hanging rope length controller, for:

moving the flexible suction hose and rigid dredging head between an inactive position located onboard the vessel and an active position located overboard, and immersing and elevating the flexible suction hose and rigid dredging head, the angular orientation of the dredging head relative to the seabed selectively changeable separate from and independent of the orientation of the suction hose and towing cable by manipulation of the hanging ropes, at least one delivery tube which is:

operably coupled at a first end to the flexible suction hose, and operably coupled at a second end to a delivery head for discharging therethrough the recovered materials into said barge, said delivery tube and delivery head being adapted to move relative to said deck, such that the delivery tube and delivery head can be:

stored above the deck in a stored orientation, and deployed outside the dredge vessel in an orientation when said recovered materials have to be discharged off the ship, wherein the towing cable adapted for:

towing the immersed dredging head when the dredge vessel is moving forward and materials are being suctioned, and the at least two hanging ropes adapted for controlling a tilt of the rigid dredging head by adjustment of the lengths of the hanging ropes by the hanging rope length controller with its first free end directed backward and resting on the seabed, a suction hose length controller for controlling the length of the flexible suction hose unrolled from the reel, a main length controller connected to both the flexible suction hose length controller and the hanging rope length controller for adjusting the unrolled length of the flexible suction hose and an unwound length of the hanging ropes in such a way that the flexible suction hose is curved along the determined length when the dredge vessel is moving forward and said materials are being sucked, wherein the flexible suction hose has a determined length between the rigid dredging head and the sea surface.

2. The floating dredge vessel of claim 1, wherein:

the rigid dredging head defines an axis along which it is elongated, the at least two hanging ropes comprises front and rear hoists corresponding to front and rear hanging ropes, the reel is positioned on said deck:

either between said front and rear hoists or of ahead the front hoist, and the flexible suction hose is connected laterally, from above, to the rigid dredging head:

either with an angle relative to said rigid dredging head axis or, along a direction parallel to said rigid dredging head axis.

3. The floating dredge vessel of claim 2, wherein both of the front and rear hanging ropes are attached to the rigid dredging head, for adjusting said tilt.

4. The floating dredge vessel of claim 1, further characterized in that:

the reel and hoisting means are positioned on said deck for moving, immersing, and elevating the flexible suction hose and inert dredging head along a first side of the hull, and the delivery head is positioned on the deck for discharging therethrough said dredged materials, outboard, into said barge along an opposite second side of the hull.

5. The floating dredge vessel of claim 1, wherein the connection between the delivery tube and the flexible suction hose allow all the suctioned mixture, including suctioned water, to be discharged outside the dredge vessel and into said barge through the delivering head, and wherein the dredging vessel comprises neither pit nor hopper for storing recovered materials on the dredging vessel.

6. A system comprising the floating dredge vessel of claim 1 and a barge floating alongside the dredge vessel, the barge comprising a loading compartment having a predetermined volume, said loading compartment having an open top and charged with the mixture, including water, the open top allowing water to overflow from the loading compartment when the recovered materials charged therein exceeds the predetermined volume.

7. The floating dredge vessel according to claim 1, wherein said delivery head and delivery tube being adapted to rotate relative to said deck about a first and a second horizontal axis for rotating between said stored orientation and deployed orientation and for an up and down movement of said delivery head.

8. A dredging method for recovering immersed materials from a seabed concession and discharging them, the method comprising:

suctioning a mixture of water and materials through a flexible hose from a first free end of an immersed dredging head which is connected to a forward moving sailing dredge vessel through the flexible hose adapted to be rolled and unrolled on a rotative reel positioned on said dredge vessel delivering the materials from the dredge vessel to one of a series of barges, characterized in that:

the step of suctioning comprises suctioning said mixture while:

the dredge vessel is sailing frontward over the seabed concession, the immersed dredging head and flexible suction hose are towed by the dredge vessel, with a towing means comprising a towing cable extending downwardly and rearwardly from said dredge vessel and said dredging head for transmitting towing forces to said dredging head and thereby isolating the flexible suction hose from towing forces, an underwater tilt of the immersed dredging head is controlled by at least two hanging ropes having hanging rope lengths extending from the ship and connected to the dredging head, the angular orientation of the dredging head relative to the seabed selectively changeable separate from and independent of the orientation of the suction hose and towing cable by manipulation of the hanging ropes, such that said dredging head has its first free end directed backward and rested on the seabed, and, the flexible suction hose has an immersed length varied such that the flexible suction hose is curved thereal-ong whatever the tilt of the dredging head, and the step of delivering comprises delivering said materials while said mixture is being suctioned.

9. The method of claim 8, wherein the step of delivering comprises immediately delivering the suctioned mixture to said one of the series of barges that is sailing alongside while the mixture is suctioned through the flexible suction hose such that no materials are accumulated on said dredge vessel.

10. The method of claim 8, wherein the curvature of the towed flexible suction hose is varied relative to the unwound length of the hanging ropes.

11. The method of claim 8, including the step of varying the curvature of the towed flexible suction hose includes the step of adapting the immersed length of the flexible suction hose by adjusting the length such that the flexible suction hose is longitudinally loosened while the rigid dredging head is resting on the seabed and suctioning materials.

* * * * *